United States Patent [19]

Bentley

[11] 4,123,822

[45] Nov. 7, 1978

[54] PINLESS HINGE STRUCTURE

[75] Inventor: Frank A. Bentley, Goshen, Ohio

[73] Assignee: NCR Corporation, Dayton, Ohio

[21] Appl. No.: 836,883

[22] Filed: Sep. 26, 1977

[51] Int. Cl.[2] ..... E05D 1/06; E05D 7/10

[52] U.S. Cl. ..... 16/128 R; 16/149; 16/171; 16/DIG. 13

[58] Field of Search ..... 16/128 R, 150, 149, 16/171-173, DIG. 13; 49/384; 220/334

[56] References Cited

U.S. PATENT DOCUMENTS

| | | | |
|---|---|---|---|
| 2,302,661 | 11/1942 | Benson | 16/172 X |
| 2,365,378 | 12/1944 | Benson | 16/171 |
| 2,637,460 | 5/1953 | Yates | 16/172 X |
| 2,644,192 | 7/1953 | McClellan | 16/172 |
| 2,834,072 | 5/1958 | Miller | 16/128 R |
| 3,134,134 | 5/1964 | McCubbin | 16/153 |
| 3,179,214 | 4/1965 | Hilfiker | 16/128 R |
| 3,388,421 | 6/1968 | Koziol | 16/171 |
| 3,422,488 | 1/1969 | Horstman | 16/165 |
| 3,710,419 | 1/1973 | De Groft | 16/171 |
| 3,803,668 | 4/1974 | Remick | 16/128 R |
| 3,868,746 | 3/1975 | Dobrjanskyj et al. | 16/128 R |
| 3,911,528 | 10/1975 | Rojic, Sr. | 16/128 R |
| 3,952,369 | 4/1976 | Erickson | 16/171 |

FOREIGN PATENT DOCUMENTS

| | | | |
|---|---|---|---|
| 566,761 | 9/1957 | Italy | 16/171 |

*Primary Examiner*—James Kee Chi

*Attorney, Agent, or Firm*—J. T. Cavender; Albert L. Sessler, Jr.; Elmer Wargo

[57] ABSTRACT

A pinless hinge structure including first and second members, with the first member having a slot therein and also having first and second bearing surfaces on opposed sides of the slot, and with the second member having opposed, generally convex and concave surfaces. When the first and second members are assembled to form the hinge structure, the generally convex and concave surfaces of the second member face the first and second bearing surfaces, respectively, to enable the first and second members to pivot with respect to each other.

14 Claims, 11 Drawing Figures

FIG. 1
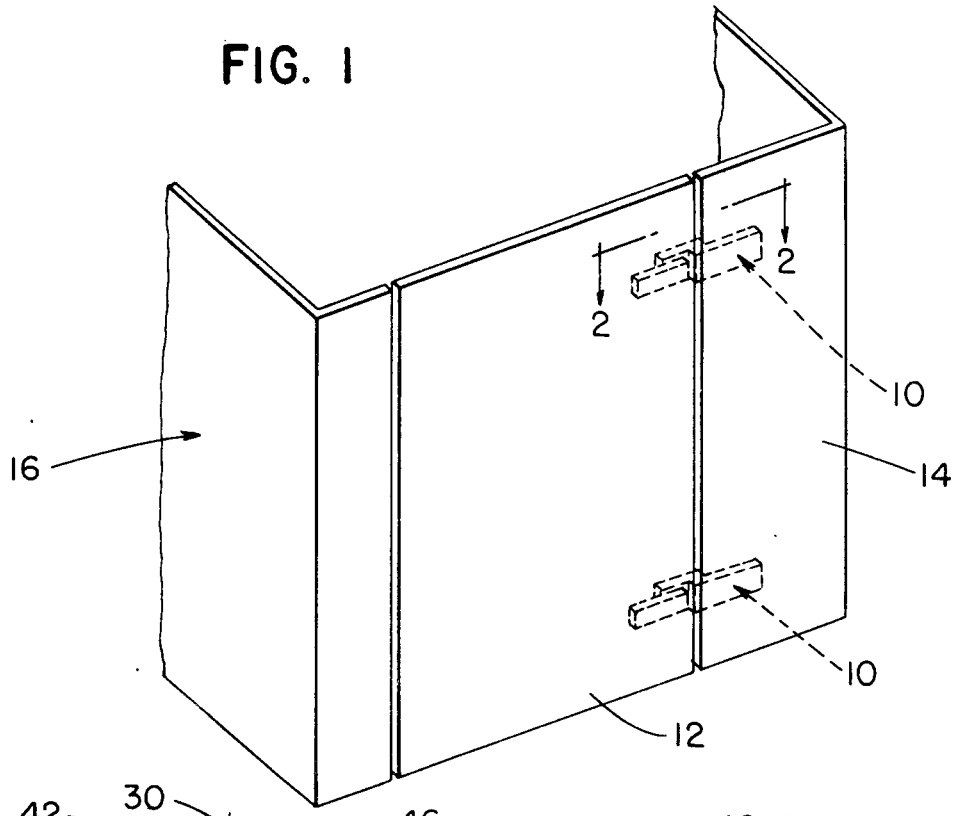
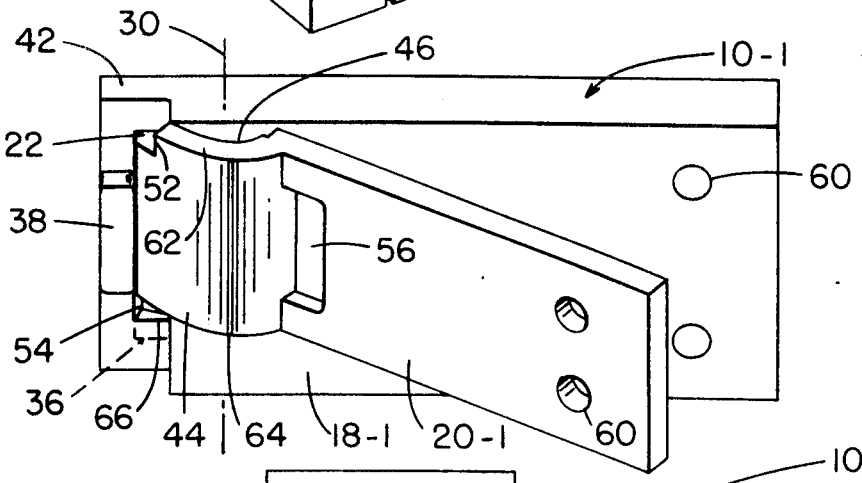
FIG. 10
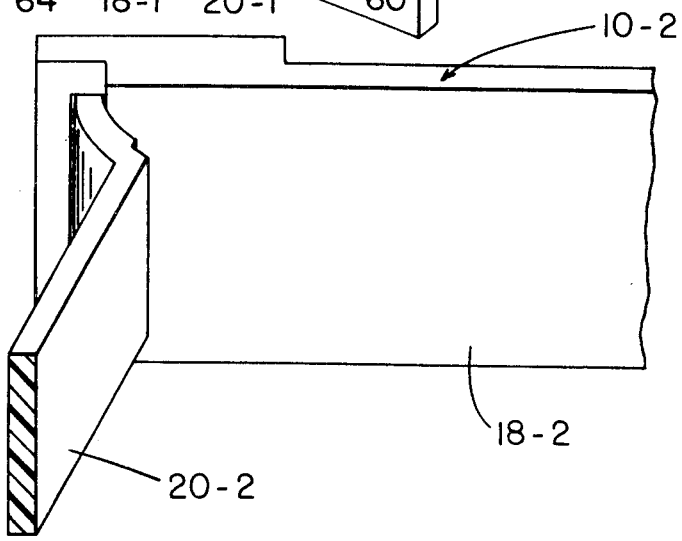
FIG. 11

PINLESS HINGE STRUCTURE

BACKGROUND OF THE INVENTION

This invention relates to a structure which enables one member to pivot with respect to another member, and more particularly, it relates to a hinge structure which is commonly referred to as a pinless hinge.

Some of the problems associated with known pinless hinges are that they are generally expensive to produce and generally do not provide a flush or neat appearance.

SUMMARY OF THE INVENTION

This invention relates to a structure comprising a first member having an opening therein with first and second surfaces on opposed sides of the opening and also comprising a second member having opposed generally convex and concave surfaces thereon. When the first and second members are assembled, the opposed generally convex and concave surfaces of the second member face the first and second surfaces, respectively, to enable the first and second members to pivot with respect to each other.

Some of the advantages of this invention are as follows:

1. The second member may be integrally formed with a door, and the first member may be integrally formed with a stationary member, for example, to enable the door and stationary member to be hinged together without additional parts and to be separated from each other without the use of separate tools;

2. Travel limits can be incorporated in the structure of this invention;

3. The structure of this invention can be concealed when the first and second members of the structure are in a closed position;

4. The structure of this invention can be completely molded and integrally formed with a door and stationary member, for example, as stated in paragraph (1) above, whereby only some slight additional tool and material costs are necessary to produce the resulting combination; and 5. The hinge principle involved in this invention can be applied to hinges having either horizontal or vertical axes.

These and other advantages will become more readily apparent from the following specification, claims and drawing.

BRIEF DESCRIPTION OF THE DRAWING

FIG. 1 is a general perspective view, showing a typical application for the structure of this invention;

FIG. 10 is a general perspective view of a second embodiment of the structure of this invention, showing how the first and second members are positioned to enable the structure to be assembled; and FIG. 11 is a general perspective view of a third embodiment of this invention, showing the first and second members in a partially open position.

DETAILED DESCRIPTION OF THE INVENTION

Figure 2:
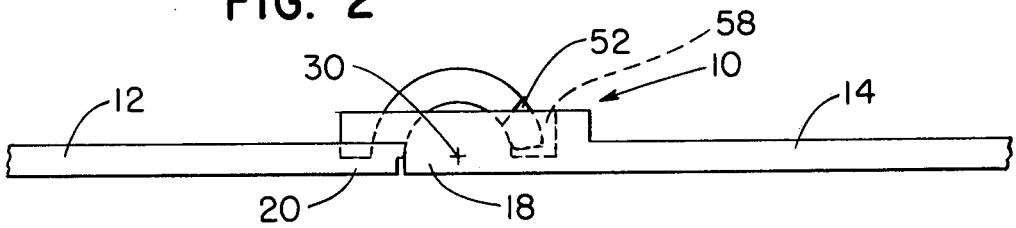
FIG. 2 is a general plan view, taken along the line 2—2 of FIG. 1, showing the first and second members of the structure of this invention as discrete elements in assembled relationship and in the closed position.

FIG. 1 is a general view, in perspective, showing the structure 10 (in dashed outline) of this invention as used in a typical application to hinge a door 12 to a stationary panel 14 of a cabinet 16. While two such structures 10 are shown, the actual number used naturally depends upon the particular application in which the structure 10 is used.

The structure 10 includes the first member 18 and the second member 20 which are shown assembled and in the closed position in FIG. 2. The first member 18 is shown as being integrally formed with the panel 14, and similarly, the second member 20 is shown as being integrally formed with the door 12, although the first and second members of the structure 10 can be made as separate or discrete elements as shown in FIG. 10, for example. In FIGS. 2–9, the door 12 and stationary panel 14 are shown as simple extensions of the structure 12 in order to simplify the drawing.

The first member 18, shown in FIGS. 2–6, has an opening or elongated slot 22 formed therein to produce the arcuate or cylindrical first and second surfaces 24 and 26, respectively, which are located on opposed sides of a portion of the slot 22 which is a general four-sided slot. In the preferred embodiment, the first surface 24 is a concave cylindrical surface whose radius of curvature 28 has its center located at the common longitudinal axis 30 of the structure 10, and the second surface 26 is a convex cylindrical surface whose radius of curvature 32 also has its center located at the common longitudinal axis 30. The second surface 26 is extended, as at 34, to additionally support the second member 20 when the structure 10 is in the closed position shown in FIG. 2. The first member 18 also has the abutment member 36 located at one end of the slot 22 to coact with the second member 20 to limit the travel of the second member 20 as it approaches the opened position; this aspect will be described in detail hereinafter.

The first and second surfaces 24, 26 provide the bearing surfaces to enable the first and second members 18, 20 to pivot with respect to each other around the common longitudinal axis 30. Because the first surface 24 is small in area when compared to the second surface 26, additional surface area may optionally be provided by adding the support block 38, with the support block 38 having a concave surface 40 which has the radius of curvature 28 and is coextensive with the first surface 24. The first surface 24 is located in an offset portion 42 of the first member 18 to provide a flush type appearance when the structure 10 is in the closed position.

Figure 7:
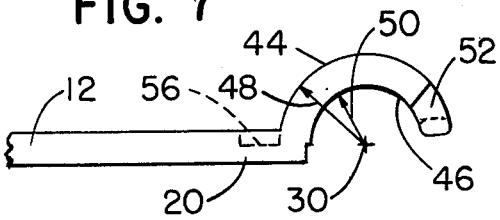
FIG. 7 is a view of the second member shown in FIG. 2.
Figure 3:
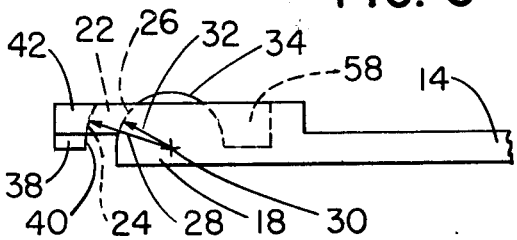
FIG. 3 is a view of the first member shown in FIG. 2.
Figure 8:
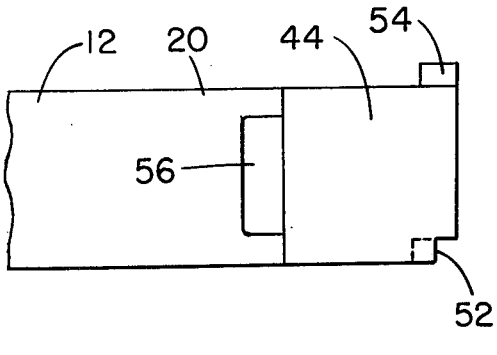
FIG. 8 is a rear or underside view of the second member as rotated 90° from the position shown in FIG. 7.
Figure 4:
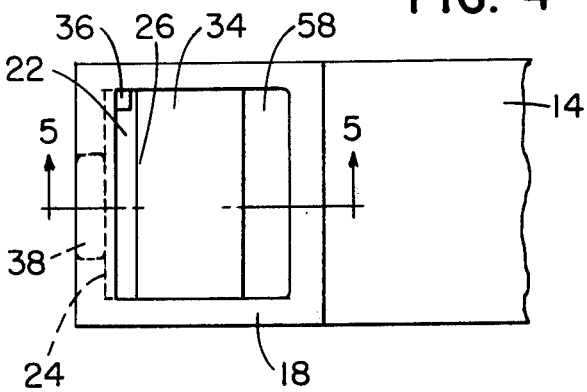
FIG. 4 is a rear or underside view of the first member as rotated 90° from the position shown in FIG. 3.
Figure 5:
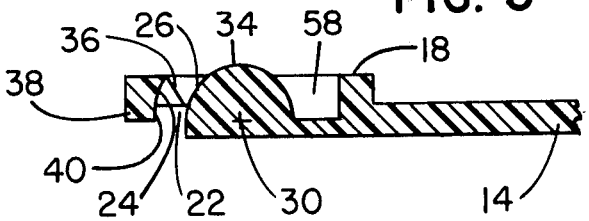
FIG. 5 is a cross sectional view, taken along the line 5—5 of FIG. 4, showing additional details of the first member.
Figure 9:
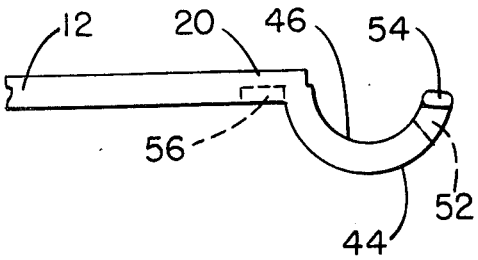
FIG. 9 is a view of the second member as rotated 90° from the position shown in FIG. 8.
Figure 6:
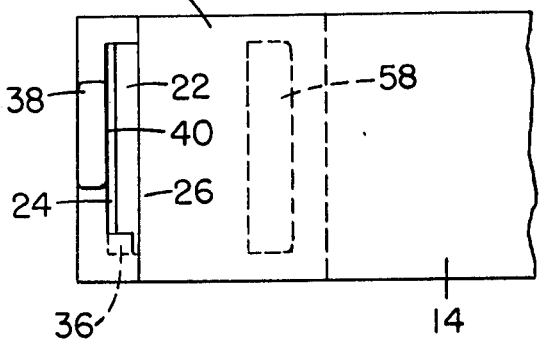
FIG. 6 is a front or outside view of the first member.

The second member 20 has opposed generally convex and concave surfaces 44 and 46, respectively, located on one end thereof as shown in FIGS. 7–9. In the preferred embodiment, the convex and concave surfaces 44, 46 may be formed as a hollow cylinder, with the convex surface 44 having a radius of curvature 48 whose center lies on the common axis 30 (when in the assembled relationship shown in FIG. 2), and similarly, with the concave surface 46 having a radius of curvature 50 whose center also lies on the common axis 30.

The second member 20 has a portion removed from one end thereof to provide a notch 52 (FIGS. 7–9) which facilitates the assembly of the first and second members 20 and 18. The second member 20 also has an abutment member 54 extending from one side thereof to cooperate with the abutment member 36 located in the first member 18 (best shown in FIGS. 4 and 5) to limit the travel of the second member 20 towards the open position. The second member 20 may optionally be provided with a well or recess 56 whenever the first member 18 is optionally provided with the support block 38 to thereby receive the support block 38 when the structure 10 is in the closed position shown in FIGS. 1 and 2 to thereby provide a flush appearance. The first member 18 also has a well or recess 58 located therein to receive the end of the second member 20 when the structure is in the closed position shown in FIG. 2.

The structure 10-1 shown in FIG. 10 is substantially the same as the structure 10 shown in FIGS. 1-9; however, the structure 10-1 is shown as a discrete item, i.e., not integrally formed with any door or support panels, and consequently, the structure 10-1 can be conventionally used as a hinge structure. The main difference between the structures 10 and 10-1 is that the first and second elements 18-1 and 20-1 are provided with mounting holes 60 to enable the structure 10-1 to be conventionally mounted on associated elements (not shown) to be hinged together; consequently, the reference numerals used for structure 10 are used to designate similar elements in structure 10-1.

Because the method used for assembling the various embodiments of this invention is the same, the structure 10-1 shown in FIG. 10 will be used to describe the method. The first step in the method is to place the second member 20-1 in the approximate position shown relative to the first member 18-1. When so done, the notch 52 of the second member 20-1 is positioned close to the upper portion of slot 22 (as viewed in FIG. 10) to enable the abutment member 54 on the second member 20-1 to pass over the abutment member 36 on the first member 18-1. When this is done, the second member 20-1 is moved downwardly (as viewed in FIG. 10) along the longitudinal common axis 30 to enable the upper portion (designated 62) of the second member 20-1 to enter the slot 22. As the second member 20-1 is rotated in a clockwise direction (as viewed in FIG. 10) the second member 20-1 will pivot relative to the first member 18-1 along the common axis 30 until the first and second members 18-1, 20-1 assume the closed position shown in the structure 10 shown in FIG. 2. During the pivoting movement just described, the convex surface 44 of the second member 20-1 faces the first surface 24 of the first member 18-1 and the concave surface 46 of the second member 20-1 faces the second surface 26 of the first member 18-1, and the lower surface 64 of the second member 20-1 rides on the upper surface or edge 66 of the abutment member 36 located on the first member 18-1. When the structure 10-1 is to be "opened", the second member 20-1 is pivoted around the common axis 30 in a counterclockwise direction as viewed in FIG. 10. The pivoting movement in the counterclockwise direction is limited by the abutment member 54 on the second member 20-1 contacting the abutment member 36 located in the slot 22.

The method for removing the second member 20-1 from the first member 18-1 is the opposite of that employed for assembling the structure 10-1. In this regard, the second member 20-1 is pivoted until the abutment member 54 abuts against the abutment member 36 as described in the previous paragraph, and then the second member 20-1 is simply moved upwardly (as viewed in FIG. 10) along the longitudinal common axis 30 to permit the abutment member 54 to clear the abutment member 36, thereby permitting separation of the first and second members 20-1 and 18-1.

The structure 10-2 shown in FIG. 11 is the same as the structure 10 shown in FIGS. 1–9; however, the support block 38 and the associated recess 56 (best shown in FIG. 10) are eliminated. The support block 38 and the associated recess 56 are eliminated for smaller hinge structures in which the hinging load is small. FIG. 11 also shows the structure 10-2 in a semi-open position.

While the several embodiments of this invention may be made of various metals and other materials, it is advantageous to make the structures like 10, for example, out of plastic materials which enable the structure 10 to be formed with the associated elements, like door 12 and stationary panel 14. In this regard, the structure 10, and associated elements to be hinged thereby, may be made conventionally of a structural foam such as Noryl foam which is manufactured by General Electric Company. The structure 10 can also be made of plastic material by conventional injection molding techniques.

While the hinge structure of this invention may be made in almost any size, one embodiment of this invention included the structure 10 having the following typical dimensions:

radius of curvature 28 equal to approximately 0.79–0.81 inch,
radius of curvature 32 equal to approximately 0.48–0.50 inch,
radius of curvature 48 equal to approximately 0.77–0.79 inch, an
radius of curvature 50 equal to approximately 0.50–0.52 inch.

What is claimed is:

1. A two-piece, pinless, hinge structure comprising:
a first member having a general four-sided opening formed therein with first and second surfaces being formed on opposed sides of said opening; and
a second member having opposed generally convex and concave surfaces thereon;
said generally convex and concave surfaces facing said first and second surfaces, respectively, when said first and second members are in assembled relationship to enable said first and second members to pivot with respect to each other.

2. The structure as claimed in claim 1 in which said generally convex and concave surfaces are cylindrical surfaces having a common longitudinal axis.

3. The structure as claimed in claim 2 in which said first and second surfaces, respectively, are concave and convex cylindrical surfaces having a common longitudinal axis which forms a common axis in said structure; said common longitudinal axis of said second member being coincident with said common axis of said structure.

4. A two-piece, pinless, hinge structure comprising:
a first member having a general four-sided slot formed therein with first and second sides being located on opposed sides of said slot;

an arcuately shaped surface positioned adjacent to said second side and being integrally formed with said first member; and a second member having an arcuately shaped portion on one end thereof with said arcuately shaped portion being inserted in said slot whereby said arcuately shaped surface and said first side provide bearing surfaces to enable said first and second members to pivot relative to each other.

5. The hinge structure as claimed in claim 4 in which said arcuately shaped surface has a longitudinal axis which forms a common axis of rotation for said hinge structure.

6. The hinge structure as claimed in claim 5 in which said arcuately shaped surface is convex and said first side has a concave surface having a longitudinal axis which is coincident with said common axis of rotation.

7. The hinge structure as claimed in claim 6 in which said arcuately shaped portion of said second member has opposed convex and concave surfaces having a common longitudinal axis which is coincident with said common axis of rotation, with said arcuately shaped portion of said second member being dimensioned to enable said convex surface of said second member to slidably engage said concave surface of said first side and said concave surface of said second member to slidably engage said arcuately shaped surface.

8. The hinge structure as claimed in claim 7 further comprising means for limiting the pivoting of said first and second members relative to each other.

9. A two-piece, pinless hinge structure comprising:

a first member having a general four-sided slot formed therein with an integrally formed concave cylindrical surface and an integrally formed convex cylindrical surface positioned on opposed sides of said slot, with said concave and convex cylindrical surfaces having a common longitudinal axis; and a second member having a hollow cylindrical section on one end thereof, which said hollow cylindrical section is dimensioned to fit between said concave and convex cylindrical surfaces of said first member to be pivotally supported thereby to enable said first and second members to pivot with respect to each other;

said hollow cylindrical section having a longitudinal axis which is coincident with the common longitudinal axis of said concave and convex cylindrical surfaces.

10. The pinless hinge structure as claimed in claim 9 in which said first member has a first abutment member which extends into said slot and said second member has a second abutment member on said hollow cylindrical section to coact with said first abutment member to thereby limit the pivoting of said first and second members relative to each other.

11. The pinless hinge structure as claimed in claim 10 in which said hollow cylindrical section has a portion removed therefrom to form a notch therein which enables said second abutment member to pass over said first abutment member when said hollow cylindrical section is inserted into said slot in said first member.

12. The pinless hinge structure as claimed in claim 11 in which said second member has a planar section joining said hollow cylindrical section, and said first member has an offset portion in which said concave cylindrical surface is located so as to enable said first and second members to present a flush-type appearance.

13. The pinless hinge structure as claimed in claim 12 in which said offset portion of said first member has a segment thereon having a second concave cylindrical surface thereon having a longitudinal axis which is coincident with said common longitudinal axis of said concave and convex cylindrical surfaces, and said planar section of said second member has a recess therein to receive said segment to thereby provide said flush-type appearance.

14. The pinless hinge structure as claimed in claim 12 further comprising a third member which is integrally formed with said first member to form a support structure, and further comprising a fourth member which is integrally formed with said second member to enable said fourth member to be pivoted with respect to said support structure.

* * * * *